US006890124B2

(12) United States Patent
Provenzano, III

(10) Patent No.: US 6,890,124 B2
(45) Date of Patent: May 10, 2005

(54) METHOD FOR PROVIDING A PRE-CAST DETECTABLE WARNING TILE SYSTEM

(75) Inventor: Peter J. Provenzano, III, Wooster, NY (US)

(73) Assignee: Detecto-Tile, Inc., Worcester, NY (US)

( * ) Notice: Subject to any disclaimer, the term of this patent is extended or adjusted under 35 U.S.C. 154(b) by 0 days.

(21) Appl. No.: 10/850,633

(22) Filed: May 20, 2004

(65) Prior Publication Data

US 2005/0013662 A1 Jan. 20, 2005

Related U.S. Application Data

(62) Division of application No. 10/233,224, filed on Aug. 31, 2002.

(51) Int. Cl.[7] ..... E01C 5/00
(52) U.S. Cl. ..... 404/73; 404/42; 249/2
(58) Field of Search ..... 404/6, 9, 15, 17–19, 404/34–36, 42, 72, 73, 75, 82, 89, 93, 99; 52/390, 391; 249/2

(56) References Cited

U.S. PATENT DOCUMENTS 3,484,514 A * 12/1969 Longinotti ..... 264/163
4,135,840 A * 1/1979 Puccini et al. ..... 404/93
4,620,816 A * 11/1986 Kupfer ..... 404/6
4,665,673 A * 5/1987 Diana ..... 52/314
4,776,723 A * 10/1988 Brimo ..... 404/89
4,828,426 A * 5/1989 Hendricks et al. ..... 404/93
4,932,182 A * 6/1990 Thomasson ..... 52/318
4,997,308 A * 3/1991 Welling, Jr. ..... 404/38
5,061,172 A * 10/1991 Fennessy, Sr. ..... 425/385
5,271,690 A * 12/1993 Fennessy, Sr. ..... 404/9
5,302,049 A * 4/1994 Schmanski ..... 404/42
5,320,790 A * 6/1994 Lowe ..... 264/31
5,487,526 A * 1/1996 Hupp ..... 249/2
5,733,470 A * 3/1998 Roth et al. ..... 249/2
5,887,846 A * 3/1999 Hupp ..... 249/2
5,927,034 A * 7/1999 Cole ..... 52/391
6,499,910 B1 * 12/2002 Grahmbeek et al. ..... 404/75
6,718,714 B1 * 4/2004 Montgomery, Sr. ..... 52/392

* cited by examiner

*Primary Examiner*—Robert E. Pezzuto
*Assistant Examiner*—Alexandra K. Pechhold
(74) *Attorney, Agent, or Firm*—Jennifer Meredith, Esq.; Meridith & Keyhani, PC

(57) ABSTRACT

A pre-cast textured tile system and method for positioning on walkways, crosswalks and other areas of pedestrian traffic for providing direction and warning to visually handicapped persons. The tile may be made for embedding in fresh concrete on a walking surface and have a substantially planar piece with a top surface and a bottom surface, the top surface having a plurality of raised elements and the bottom surface being scarified. A number of the tiles may be aligned so as to easily adapt to a number of different shapes and purposes. The tiles are not interconnected, but rather abut one another with at least one edge being flush to the walking surface.

19 Claims, 5 Drawing Sheets

METHOD FOR PROVIDING A PRE-CAST DETECTABLE WARNING TILE SYSTEM

This application claims priority to U.S. patent application Ser. No. 10/233,224 as a divisional application filed Aug. 31, 2002.

BACKGROUND OF THE INVENTION

The present invention generally relates pedestrian platforms, walkways and sidewalks and more particularly to pedestrian platforms, walkways and sidewalks for the blind and visually impaired.

There is often the need, in public transit facilities, for pedestrians to detect the location of a platform or other potential hazards. By making the pedestrian aware of a potential hazard, they may avoid the hazard. By way of example, this may include railroad crossings, subway platforms, loading docks, stages, stairways, sidewalks, curb ramps, crosswalks, man holes, potholes, etc.

Americans with Disabilities Act (ADA): "Accessibility Guidelines for Buildings and Facilities" set the requirements for the use of detectable warnings at curb ramps, walking surfaces, transit platforms and the like to warn visually impaired people of hazards. The guidelines require that detectable warnings shall consist of truncated domes with a diameter of nominal 0.9" (23 mm), a height of nominal 0.2" (5 mm) and a center-to-center spacing of nominal 2.35" (60 mm) and shall contrast visually with adjoining surfaces, either light on dark or dark on light. The material used to provide contrast shall be an integral part of the walking surface. Detectable warnings use on interior surfaces are required to differ from adjoining surfaces in resiliency or sound-on-cane contact. Platform edges bordering a drop off and not protected by screens or guard rails shall have a detectable warning 24 inches wide running the full length of the platform drop off. If a walkway crosses or adjoins a vehicular way, and the walking surface is not separated by curbs, railing or other element between the pedestrian areas and the vehicular areas, the boundary between such area is to be defined by a continuous detectable warning 36 inches wide. Curb ramps are also required to have detectable warnings extending the full width and depth of the curb ramp.

Known within the art are tiles designed to be glued or mechanically fastened to the existing walking surface. U.S. Pat. No. 4,715,743 issued to Schmanski discloses a uniform adhesive layer applied to a tile, which is then adhered to a surface. Tiles installed according to this method are not flush with the ground and may come undone.

Also known within the art is the use of a patterned tool to produce a durable tactile warning surface for sidewalks and other walkways including pouring a concrete base, applying pigmented or colored hardener to the upper surface of the concrete base and stamping the upper surface of the converter base with a patterned tool. This can be very costly, incurring labor costs due to the waiting periods between pouring and stamping and the requirement of on-site labor to perform the stamping. Also, there is a great deal of room for imperfections and error.

Adherence of the tile to a walkway surface is a critical aspect of the present invention. Prior efforts to retain the tile in an attached position have been frustrated by separation of the peripheral edge of the tile from the pavement. Prior attempts to solve this problem have included the stamping of concrete, plastic tiles with chamfered edges and the like. However, as discussed previously, stamping is costly, prone to errors, labor intensive and requires on site work. Plastic tiles are much more fragile and subject to lifting and coming undone.

Accordingly, what is needed is a textured tile system and method of installation that allows for pre-cast tiles to be easily installed, that abut the edge of the walking surface, do not require labor intensive on-site stamping, provides fewer imperfections, is in compliance with the ADA and may freely move relative to one another.

SUMMARY OF THE INVENTION

The present invention provides tiles and a method of installing textured tiles which can be embedded in freshly poured cement at a walking surface and pre-cast in concrete. The textured tiles may be installed and incorporated into a surface so as to provide visual and tactile warnings. This may be particularly useful to disabled individuals and in particular the visually impaired.

According to one aspect of the present invention, a pre-cast textured tile for embedding in fresh concrete on a walking surface is disclosed comprising a substantially planar piece with a top surface and a bottom surface. The top surface having a plurality of raised elements and the bottom surface being scarified.

According to yet another aspect of the present invention, a pre-cast tile system is disclosed for use on a walking surface for providing direction and warning to visually handicapped persons. The pre-cast tile system may be comprised of a multitude of substantially rectangular planar pieces with a top surface and a bottom surface. The top surface having a plurality of raised elements projecting upward therefrom and being configured as a truncated dome structure and the bottom surface being scarified. There may also be a multitude of substantially angled planar cut pieces with a top surface and a bottom surface, the top surface having a plurality of raised element projecting upward therefrom and being configured as a truncated dome structure and the bottom surface being scarified. The substantially angled planar cut pieces and the substantially rectangular planar pieces may be placed together so as to form a walking surface which is flush to the edge of a walking surface.

According to yet another aspect of the present invention, a method of producing a textured warning surface of a sidewalk is disclosed comprising the steps of preparing a concrete mix suitable for pouring the concrete mix into a receiving form, wherein the receiving form has a raised pattern embedded therein; adding coloring agent to form a concrete mix; pouring the concrete mix into the form; scarifying the bottom surface of the concrete mix; allowing the concrete mix to cure forming a textured warning surface, wherein the textured warning surface has a plurality of raised elements formed on a top surface and the textured warning surface is scarified on a bottom surface; and sealing the top surface.

These and other features, aspects and advantages of the present invention will become better understood with reference to the following drawings, description and claims.

DETAILED DESCRIPTION OF THE INVENTION

The present invention may be used as a detectable warning to individuals, and in particular visually impaired individuals against potential hazards. Also, the present invention is intended to provide a highly efficient method of bringing present sidewalks and walking surfaces to compliance with the requirements of the ADA Accessibility Guidelines. It is envisioned that the tiles may be applied to any area where a detectable warning is desired including loading docks, stages, subway platforms, speaking platforms, stairway tops, landings, docks, pools, piers, steep slopes, curbs, potholes, restricted areas, manholes and the like. Also, as the language of detectable warnings progresses, it is intended that the top surface of the present invention may be patterned accordingly. For instance, the top portion of the concrete may have raised bars or other patterns known within the art to serve the purpose of directing or informing those with disabilities.

Figure 1:
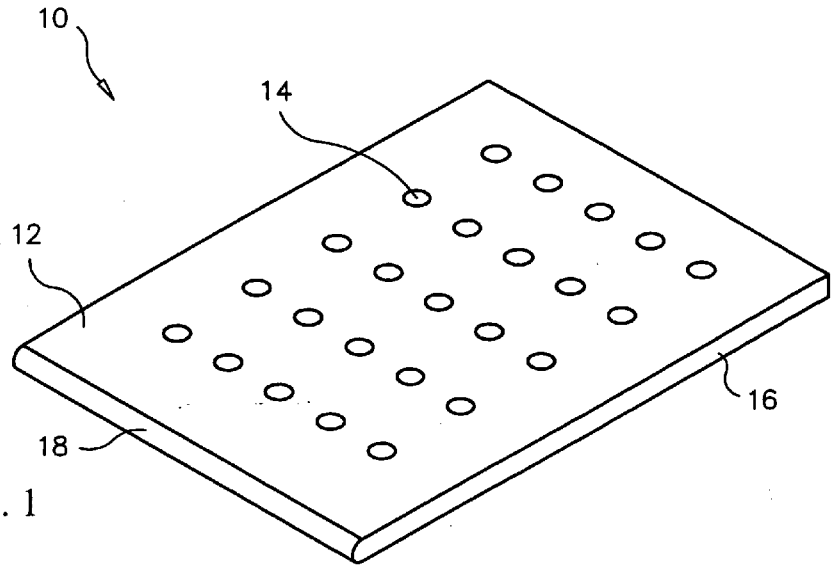
FIG. 1 depicts an elevational view according to the present invention.

As shown in FIG. 1, a pre-cast textured tile 10 made for embedding in fresh concrete on a walking surface comprising a substantially planar piece with a top surface and a bottom surface, the top surface having a plurality of raised elements and the bottom surface being scarified. The raised element may be a truncated dome, and be between 0.2 and 1 inches above the surface of the tile.

Figure 2:
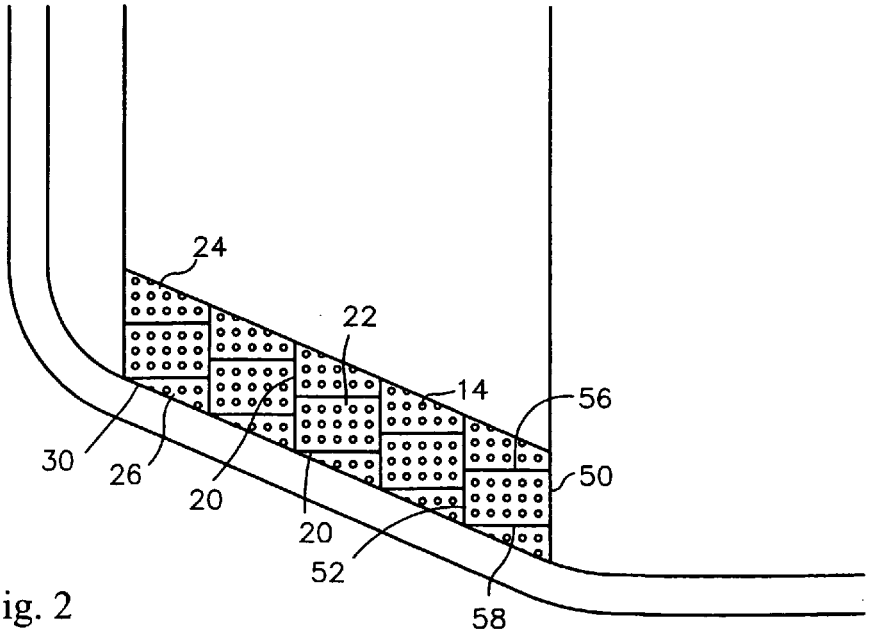
FIG. 2 depicts a system according to the present invention.

A pre-cast tile system is shown in FIG. 2, for use on a walking surface for providing direction and warning to visually handicapped persons. The pre-cast tile system comprising a multitude of substantially rectangular planar pieces 20 with a top surface 22 and a bottom surface (not shown), the top surface 22 having a plurality of raised elements 14 projecting upward therefrom and being configured as a truncated dome structure. The bottom surface (not shown) is scarified. There may also be a multitude of substantially angled planar cut pieces 24 with a top surface 26 and a bottom surface (not shown). The top surface 26 having a plurality of raised elements 14 projecting upward therefrom and being configured as a truncated dome structure and the bottom surface (not shown) being scarified. The substantially angled planar cut pieces 24 and the substantially rectangular planar pieces 22 are placed together so as to form a walking surface which is flush to the edge 30 of a surface. At least one edge of the substantially angled planar cut pieces 24 abuts at least one edge of the substantially rectangular planar pieces 20.

According to the embodiment depicted in FIG. 2, the surface is a curb.

At least one edge of the substantially angled planar cut pieces 24 may be flush with a walking surface. According to another embodiment, at least one edge of the substantially rectangular planar pieces 22 may be flush with a walking surface.

According to the embodiment depicted in FIG. 2, a multitude of substantially rectangular planar 22 pieces each have two opposite side edges (by way of example, 50 and 52) intended for alignment with corresponding side edges of other tiles, and front edge 58 and rear edges 56 at least one of which is a traffic facing edge 58, in which raised elements 14 adjacent the traffic facing edge are lower in height than raised element 14 elsewhere on the tile. The tile thus having raised elements of a gradual height increase. It should be understood that the raised elements may be of uniform height or vary, without departing from the present invention.

Figure 3:
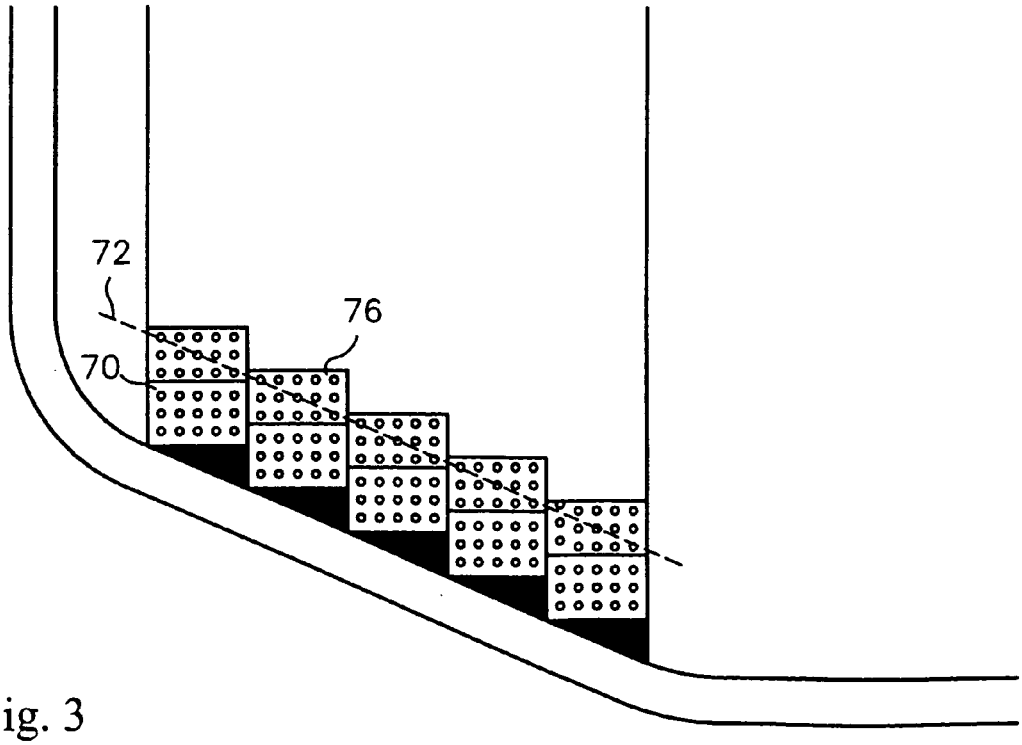
FIG. 3 depicts a system according to the present invention.
Figure 4:
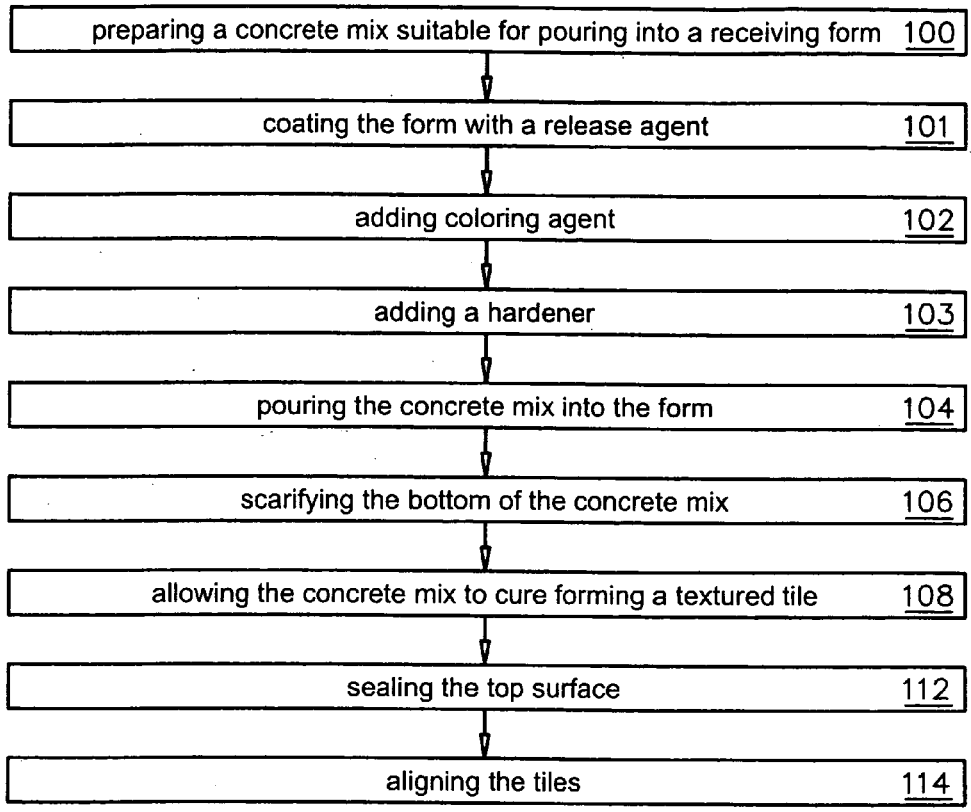
FIG. 4 depicts a method according to the present invention.

FIG. 3 depicts a manner in which the shaped may be properly fitted to any area. As shown, the pre-cast tiles 70 may be cut along a line 72 which corresponds in shape to the curb 74. The cut portion 76 may then be removed and placed into the area 78. In this way, the exact shape may be tailored on site.

According to another embodiment, a method of producing a textured warning surface of a sidewalk is disclosed the method comprising: preparing a concrete mix suitable for pouring into a receiving form 100, wherein the receiving form has a raised pattern embedded therein; optionally, coating said form with a release agent 101; adding coloring agent 102 to form a concrete mix; optionally adding a hardener 103; optionally adding a pouring the concrete mix into the form 104; scarifying the bottom surface of the concrete mix 106; allowing the concrete mix to cure forming the textured tile 108, wherein the textured tile has a plurality of raised elements formed on a top surface and the textured tile is scarified on a bottom surface; optionally, the process (steps 104–108) may be repeated 110 to produce a multitude of tiles; and sealing the top surface (112). Optionally, a hardener may be applied to the concrete mix. The form may be a urethane pad and the raised pattern embedded therein may be a truncated dome.

According to the embodiment, wherein a multitude of textured tiles are form by repeating 110 steps 104 to 112, the step 114 of aligning the textured tiles so that at least one edge of the multitude of textured tiles is flush to a surface. At least one tile may be a substantially rectangular planar piece with a top surface, bottom surface, and at least three edges. The top surface having a plurality of raised elements projecting upward therefrom and being configured as a truncated dome structure. The bottom surface being scarified. At least one tile may be a substantially angled planar cut piece with a top surface, a bottom surface, and at least three edges. The top surface of the substantially angled planar cut piece having a plurality of raised elements projecting upward therefrom and being configured as a truncated dome structure and the bottom surface being scarified. At least one of the at least three edges of the substantially rectangular planar piece may be aligned with at least one of the at least three edges of the substantially angled planar cut piece.

The concrete mix according to a preferred embodiment is a non-shrink grout blend of portland cements, admixtures, and aggregates. This material is designed to provide high flexural, and compressive strength performance from damp pack to fluid consistencies. All surfaces in contact with the non-shrink grout should be free of dirt, oil, grease, laitance, and other contaminants. The temperature of contact areas should be maintained between 45° F.(7° C.) and 90° F. (32° C.) prior to grouting and during initial curing period.

Figure 5:
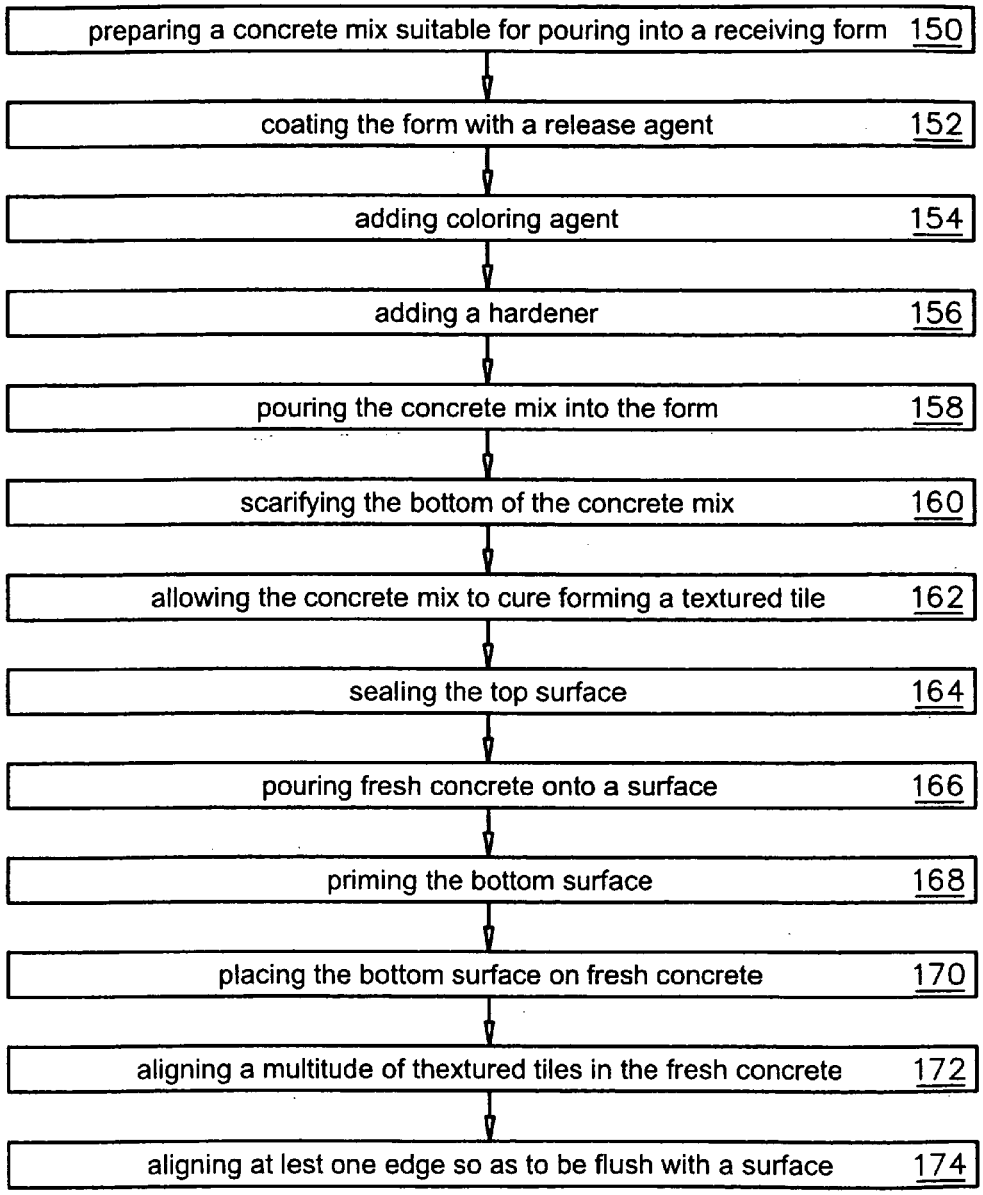
FIG. 5 depicts a method according to the present invention.

As shown in FIG. 5, a method of producing a textured tile system for use as a warning surface is disclosed, the method comprising: preparing a concrete mix suitable into a receiving form 150, wherein the receiving form has a raised pattern embedded therein; optionally coating the form with a release agent 152; adding coloring agent to form a concrete mix 154; optionally adding a hardener 156; pouring the concrete mix into the form 158; scarifying the bottom surface of the concrete mix 160; allowing the concrete mix to cure forming the textured tile 162, wherein the textured tile has a plurality of raised elements formed on a top surface and the textured tile is scarified on a bottom surface; sealing the top surface of the textured tile 164; pouring fresh concrete onto a surface 166; priming the bottom surface of the textured tiles with a binding agent 168; and placing the bottom surface of the textured tiles on fresh concrete 170; optionally, aligning a multitude of textured tiles in the fresh concrete 172; and aligning at least one edge so as to be flush with a surface 174.

As in the previous embodiments, the at least one tile may be a substantially rectangular planar piece with a top surface, bottom surface, and at least three edges, and at least one tile is a substantially angled planar cut pieces with a top surface, a bottom surface, and at least three edges. At least one of the at least three edges of the substantially rectangular planar piece may be aligned with at least one of the at least three edges of the substantially angled planar cut piece. At least one edge of at least one tile may be aligned so as to be flush with a surface. The surface may be any area where a detectable warning is desired including loading docks, stages, subway platforms, speaking platforms, stairway tops, landings, docks, pools, piers, steep slopes, curbs, potholes, restricted areas, manholes and the like.

Figure 6:
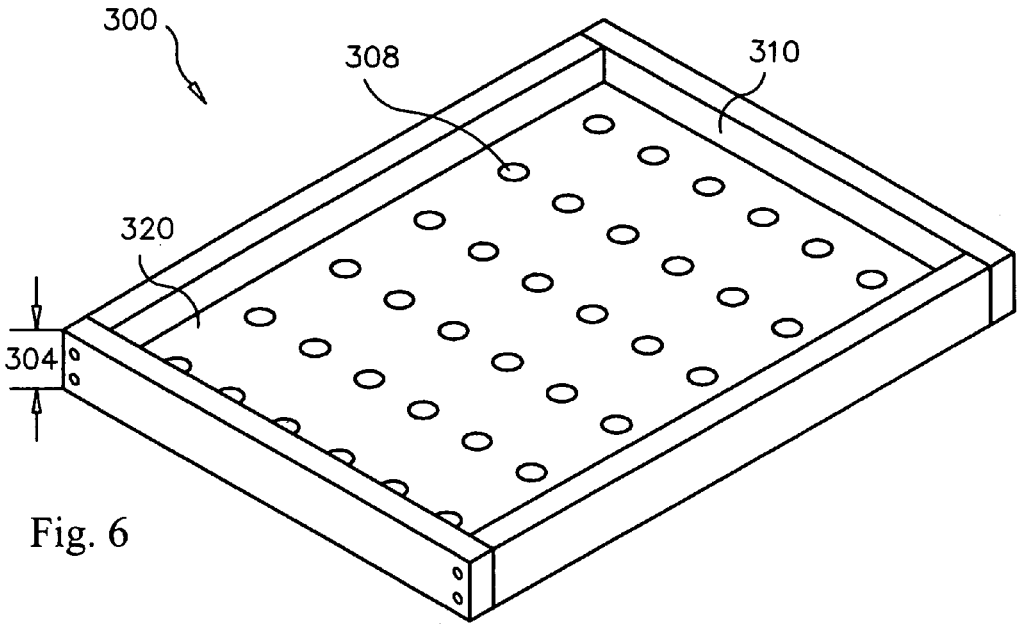
FIG. 6 depicts form according to the present invention.
Figure 7:
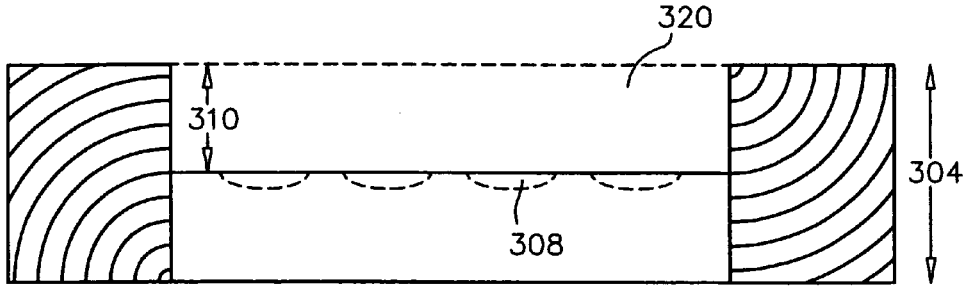
FIG. 7 is a side view according to the present invention.

FIGS. 6 and 7 depict a form 300 according to the present invention. As shown, the form may have an inner height 310 of 1½" and an outer height 304 of 2¼". The form has inverted holes 308 which form the raised elements of the textured tiles. The height 310 may be between 0.05 and 5 inches, preferably one inch. It should be understood any dimensions would not depart from the present invention, these are merely preferred dimensions. According to a preferred embodiment, the forms are made using 2¼"×1½" wood, screwed together with 2½" sheetrock screws to form rectangles. The size and spacing of the truncated domes may not allow 12"×12" sections. Therefore, sizes of sections range from 10⅞"×11⅝" to 12⅜"×14⅝". A set of 10 sections may complete a pattern that measures 5'×2'×1½".

A concrete mix is poured into the form 300 in the space 320 according to previously discussed methods. Although the terms cement and concrete often are used interchangeably, cement is actually an ingredient of concrete. Concrete is basically a mixture of aggregates and paste. The aggregates are sand and gravel or crushed stone; the paste is water and Portland cement. Concrete gets stronger as it gets older. According to a preferred embodiment of the present invention, type X Portland cement may be utilized. Portland cement is not a brand name, but the generic term for the type of cement used in virtually all concrete. Cement comprises from 10 to 15 percent of the concrete mix, by volume. Through a process called hydration, the cement and water harden and bind the aggregates into a rocklike mass. This hardening process continues for years meaning that concrete gets stronger as it gets older. Because of this, it is desirable to use concrete rather than plastics or polymers. According to a preferred embodiment non-shrink grout is mixed with coloring agent and water and blended in a container using a mortar mixing blade attached to an electric drill until the desirable consistency is achieved. Typically, the color of the composition will be yellow and will conform to Federal Color No. 33538 of standard 595A. This particular yellow color is close to that final color detectable by visually handicapped persons prior to going totally blind.

Figure 8:
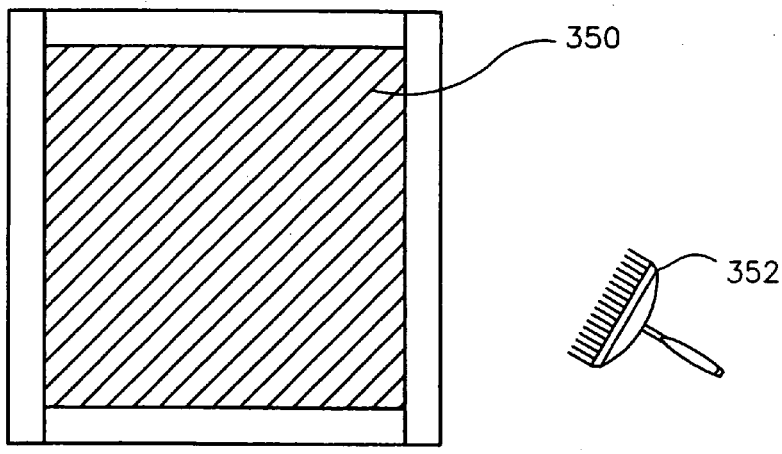
FIG. 8 is a view top view of the bottom side of a textured tile according to the present invention.

FIG. 8 depicts scarification. Once the concrete mix is poured, the bottom portion 350 may be scarified. This may be automated, or accomplished through the use of a scarifying tool 352. Also, numbers 354 may be scarified into the bottom portion 350 of the concrete, so as to identify the proper tile for future reference to form a system of well aligned tiles. For example, where a multitude of tiles of different sizes need to be pre-cast for future use, such symbols may be utilized to identify the order in which this tile should be placed, or to depict standard sizes.

Curing is one of the most important steps in concrete construction, because proper curing greatly increases concrete strength and durability. Concrete hardens as a result of hydration: the chemical reaction between cement and water. However, hydration occurs only if water is available and if the concrete's temperature stays within a suitable range. During the curing period-from five to seven days after placement for conventional concrete-the concrete surface needs to be kept moist to permit the hydration process. New concrete can be wet with soaking hoses, sprinklers or covered with wet burlap, or can be coated with commercially available curing compounds, which seal in moisture.

Temperature extremes make it difficult to properly cure concrete. On hot days, too much water is lost by evaporation from newly placed concrete. If the temperature drops too close to freezing, hydration slows to nearly a standstill. Under these conditions, concrete ceases to gain strength and other desirable properties. In general, the temperature of new concrete should not be allowed to fall below 50 Fahrenheit (10 Celsius) during the curing period.

After the mix has hardened, the section are removed and placed raised element side up or top side up, and each is sealed with a clear liquid sealer. The pieces may then be brought to a jobsite, or an area to be installed. They may be prefabricated or cut at the site to any shape. Concrete may be poured into to sidewalk and made to the proper grade. The underside of each textured tile may be primed with a bonding agent, and the sections placed into fresh concrete. This may be according to numbers on the bottom side or according to professional installation. It is desirable that the pieces be individually places, rather than interlocked as they withstand temperature changes and not succumb to cracking, chipping or damage. Also, the individual placement accommodates the transition of the normal pitch of the sidewalk to the pitch of the curb.

The following detailed description is of the best currently contemplated modes of carrying out the invention. The description is not to be taken in a limiting sense, but is made merely for the purpose of illustrating the general principles of the invention, since the scope of the invention is best defined by the appended claims.

It should be understood, of course, that the foregoing relates to preferred embodiments of the invention and that modifications may be made without departing from the spirit and scope of the invention as set forth in the following claims.

I claim:

1. A method of producing a textured warning surface of a sidewalk, said method comprising:

preparing a concrete mix suitable for pouring said concrete mix into a receiving form, wherein said receiving form has a raised pattern embedded therein;

adding coloring agent to form a concrete mix;

pouring said concrete mix into said form;

scarifying the bottom surface of said concrete mix;

allowing said concrete mix to cure forming said textured tile, wherein said textured tile has a plurality of raised elements formed on a top surface and said textured tile is scarified on a bottom surface; and sealing said top surface.

2. A method as in claim 1, further comprising the steps of applying a hardener to said concrete mix.

3. A method as in claim 1, further comprising the step of applying a release agent to said form.

4. A method as in claim 1, wherein said form is a urethane pad.

5. A method as in claim 1, wherein said step of pouring said concrete mix into said form provides a tile that is 0.6 to 3 inches in thickness.

6. A method as in claim 1, wherein said raised pattern is a truncated dome.

7. A method as in claim 1, further comprising the steps of:

forming a multitude of textured tiles;

aligning said multitude of textured tiles wherein at least one edge of said multitude of textured tiles is flush to said surface.

8. A method as in claim 1, further comprising the following steps;

providing a multitude of textured tiles wherein, at least one tile is a substantially rectangular planar pieces with a top surface, bottom surface, and at least three edges, said top surface having a plurality of raised elements projecting upward therefrom and being configured as a truncated dome structure and said bottom surface being scarified and at least one tile is a substantially angled planar cut pieces with a top surface, a bottom surface, and at least three edges said top surface having a plurality of raised element projecting upward therefrom and being configured as a truncated dome structure and said bottom surface being scarified; and aligning at least one of said at least three edges of said substantially rectangular planar piece with at least one of said at least three edges of said substantially angled planar cut piece.

9. A method as in claim 1, further comprising the step of:

aligning at least one edge of at least one tile so as to be flush with said surface.

10. A method of producing a textured tile system for use as a warning surface, said method comprising:

preparing a concrete mix suitable for pouring said concrete mix into a receiving form, wherein said receiving form has a raised pattern embedded therein;

adding coloring agent to form a concrete mix;

pouring said concrete mix into said form;

scarifying the bottom surface of said concrete mix;

allowing said concrete mix to cure forming said textured tile, wherein said textured tile has a plurality of raised elements formed on a top surface and said textured tile is scarified on a bottom surface;

sealing said top surface of said textured tile;

pouring fresh concrete onto a surface;

priming said bottom surface of said textured tiles with a binding agent; and placing said bottom surface of said textured tiles on said fresh concrete.

11. A method as in claim 10, further comprising the steps of applying a hardener to said concrete mix.

12. A method as in claim 10, further comprising the step of applying a release agent to said form.

13. A method as in claim 10, wherein said form is a urethane pad.

14. A method as in claim 10, wherein said step of pouring said concrete mix into said form provides a tile that is 0.6 to 3 inches in thickness.

15. A method as in claim 10, wherein said raised pattern is a truncated dome.

16. A method as in claim 10, further comprising the steps of:

forming a multitude of textured tiles;

aligning said multitude of textured tiles wherein at least one edge of said multitude of textured tiles is flush to said surface.

17. A method as in claim 10, further comprising the following steps;

providing a multitude of textured tiles wherein, at least one tile is a substantially rectangular planar pieces with a top surface, bottom surface, and at least three edges, said top surface having a plurality of raised elements projecting upward therefrom and being configured as a truncated dome structure and said bottom surface being scarified and at least one tile is a substantially angled planar cut pieces with a top surface, a bottom surface, and at least three edges said top surface having a plurality of raised element projecting upward therefrom and being configured as a truncated dome structure and said bottom surface being scarified; and aligning at least one of said at least three edges of said substantially rectangular planar piece with at least one of said at least three edges of said substantially angled planar cut piece.

18. A method as in claim 10, further comprising the step of:

aligning at least one edge of at least one tile so as to be flush with said surface.

19. A method of producing a textured tile system for use as a warning surface, said method comprising:

preparing a concrete mix suitable for pouring said concrete mix into a receiving urethane pad form, wherein said receiving urethane pad form has a raised pattern embedded therein;

applying a release agent to said receiving urethane pad form;

adding coloring agent to form a concrete mix;

pouring said concrete mix into a multitude of said receiving urethane pad form;

scarifying the bottom surface of said concrete mix;

applying a hardener to said concrete mix;

allowing said concrete mix to cure forming said textured tile, wherein said textured tile has a plurality of raised elements formed on a top surface and said textured tile is scarified on a bottom surface;

sealing said top surface of said textured tile;

applying a release agent to said upper surface of said concrete mix;

pouring fresh concrete onto a surface;

priming said bottom surface of said textured tiles with a binding agent;

placing said bottom surface of said textured tiles on said fresh concrete; and aligning said multitude of textured tiles wherein at least one edge of said multitude of textured tiles is flush to said surface.

* * * * *